US005123310A

United States Patent [19]

McManus

[11] Patent Number: 5,123,310

[45] Date of Patent: Jun. 23, 1992

[54] SOCKET FOR TURNING FASTENER HEADS HAVING DEFORMED HEAD SURFACES

[75] Inventor: Christopher L. McManus, Chapel Hill, N.C.

[73] Assignee: MCNC, Research Triangle Park, N.C.

[21] Appl. No.: 659,990

[22] Filed: Feb. 22, 1991

[51] Int. Cl.[5] ..... B25B 13/02

[52] U.S. Cl. ..... 81/125; 81/121.1

[58] Field of Search ..... 81/125 C, 121.1 X, 53.2, 81/909

[56] References Cited

U.S. PATENT DOCUMENTS

| | | | |
|---|---|---|---|
| 691,406 | 1/1902 | Morgan . | |
| 1,807,264 | 5/1931 | Walker | 81/53.2 |
| 2,746,328 | 5/1956 | Valvano . | |
| 2,953,049 | 9/1960 | Vilmerding | 81/125 |
| 3,094,022 | 6/1963 | Young . | |
| 3,847,042 | 11/1974 | Wilson | 81/125 |
| 4,063,472 | 12/1977 | MacIntyre et al. . | |
| 4,356,839 | 11/1982 | Voynovich . | |
| 4,920,834 | 5/1990 | Womack et al. . | |

FOREIGN PATENT DOCUMENTS

| | | | |
|---|---|---|---|
| 0608191 | 4/1926 | France | 81/125 |

*Primary Examiner*—Bruce M. Kisliuk
*Assistant Examiner*—Lawrence Cruz
*Attorney, Agent, or Firm*—Bell, Seltzer, Park & Gibson

[57] ABSTRACT

A socket for grippingly engaging the polygonal portion of a threaded fastener having deteriorated head surfaces and for transferring a moment from a tool to the fastener to turn the fastener. The socket includes a socket body, a receptacle for mating with a drive end of tool, a polygonal receptacle for receiving the polygonal portion of a fastener, and at least one set screw mounted in the socket body for urging a fastener received within the polygonal receptacle against a wall segment of the polygonal receptacle. A wrench for turning the socket is also disclosed.

35 Claims, 1 Drawing Sheet

SOCKET FOR TURNING FASTENER HEADS HAVING DEFORMED HEAD SURFACES

FIELD OF THE INVENTION

The present invention relates to tools for engaging and turning bolts, screws, nuts and similar fasteners having conventional polygonal portions. In particular, the invention relates to a socket especially adapted for engaging and turning polygonal screw or bolt heads or polygonal nuts with rounded corners or which are otherwise deformed.

BACKGROUND OF THE INVENTION

Threaded fasteners such as bolts and screws are widely used in nearly every application to secure machine parts and the like by engaging corresponding threads on a nut or work piece. These bolts and screws are commonly provided with a polygonal head portion having a series of flat surfaces with well defined corners aligned generally parallel to the axis of the threaded portion of the fastener. The head is usually hexagonal in shape, although bolts having square or other polygonal shapes are sometimes found. The polygonal head portion usually has one of a plurality of standard sizes, measured either in metric or English dimensions, so that the head may be engaged by standard size tools. A variety of tools are commonly used to engage fastener heads, including closed and open end wrenches and sockets driven by a wrench or driver portion. Fastener nuts are also typically polygonal, and may also be engaged by these tools, and any future reference to fastener heads or bolt heads will also be understood to include nuts.

A socket for turning a fastener head generally has a body portion made of a durable material such as hardened steel or the like within which a polygonal receptacle is defined. The polygonal receptacle of the socket has a size appropriate to fit a corresponding standard size head. Sockets generally provide good performance when engaging heads that are in like new condition and on which the polygonal surfaces and corners have not deteriorated. However, after repeated use, a fastener head sometimes becomes deformed, thus impeding the efficacy of a conventional socket wrench as well as other conventional tools.

The most common type of deformation occurring on a fastener head is rounding of the corners on the head. A rounded-off head, which is sometimes referred to as a stripped bolt head, may result from slippage of a wrench, socket or other tool about the fastener head when turning the fastener. Use of an improper tool or wrong size tool to turn the fastener may also damage the head surfaces. The rounded head frequently develops while attempting to turn a fastener that is very tight, or which is corrosively adhered to a surface, work piece or nut. In such situations, conventional sockets and other tools fail to provide adequate turning power and slip around the fastener head, causing damage to the head.

In the past, attempts to turn fasteners having rounded or stripped heads have enjoyed varying degrees of success. Locking pliers are often used to clamp tightly on the deformed head to turn it. The use of locking pliers, however, often causes further deformation of the head and may even destroy the head so that the fastener is no longer serviceable. For example, if the pliers are not sufficiently tight, they will slip around the head when a torque is applied. Alternatively, if the locking pliers are applied tight enough to remove a stubborn fastener, the head may be permanently deformed due to compression by the plier jaws.

A particularly problematic situation arises when a deformed fastener head is positioned within a small recessed area. Such recessed areas are frequently found on machine parts, engines and other applications where it is desirable that the fastener head not protrude above an otherwise flush surface. The recessed area for a fastener head is typically only slightly larger in diameter than the size of the fastener head, allowing only enough room for a socket to extend into the recess and engage the fastener head. This arrangement is quite acceptable when the fastener head has well defined surfaces; however, if the fastener head has become rounded or otherwise deformed, locking pliers or other known tools cannot extend into the recessed area to grasp the bolt head such that an adequate torque can be generated to turn the fastener.

Other especially designed tools are available which clamp tightly on a deteriorated fastener head or which cut into the fastener head, but these tools are also frequently destructive, rendering the fastener permanently unserviceable, or are incapable of engaging a fastener head within tightly constricted areas, or both. For example, U.S. Pat. No. 4,920,834, which issued to Womack et al. on May 1, 1990 shows a socket pipe wrench having an adjustable sliding jaw therein for turning a nut or bolt having a mutilated head. However, the tool shown in the Womack et al '834 patent cannot engage fastener heads within tightly constricted areas due to its relative bulk, and the jaw teeth may cause further damage to a deformed fastener head received therein. Likewise, U.S. Pat. No. 2,746,328, which issued to Valvano on May 22, 1956, shows a tool having wedge-like moveable jaws. However, this tool is especially adapted for removing a stud bolt lacking a polygonal head.

Another stud bolt puller is shown in U.S. Pat. No. 3,094,022, issued to Young on Jun. 18, 1963. The Young '022 stud puller has a plurality of bolts aligned transverse to the axis of the stud puller which may be adjusted to engage the stud. This tool, however, is not adapted for turning polygonal fastener heads as it has a circular interior bore. Last, French Patent No 608,191, issued to Bernard and published Jul. 22, 1926, shows a wing-nut adapter which has a socket for engaging the hexagonal head of a spark plug. A screw penetrates one vertex of the socket and may be adjusted to retain the adapter on the head; however, the adapter cannot securely engage a deformed head.

SUMMARY OF THE INVENTION

In light of the aforementioned deficiencies, it is an object of the present invention to provide a new tool for grippingly engaging the head portion of a threaded fastener and transferring a torque to the head to turn the fastener.

Another object of the present invention is to provide a socket that will extend into a recessed area to engage a fastener having a deformed head.

Yet another object of the present invention is to provide a compact, inexpensive tool for engaging a rounded fastener head without causing further deformation of the head.

A further object of the present invention is to provide a socket for turning fasteners having rounded heads which is compatible with conventional socket wrenches and drivers.

The above and other objects and advantages of the present invention are achieved in the embodiments described herein by the provision of a socket including at least one set screw which projects through the socket body into its polygonal fastener head receptacle. The set screw(s) are adjusted to securely engage a fastener head with the polygonal receptacle. The set screw(s) may be easily and inexpensively added to a standard socket wrench set to allow removal of a rounded bolt head without causing further deformation of the bolt head. Moreover, since the set screw(s) may be flush with the outer surface of the socket, the socket may be extended into a recessed area to engage a bolt head therein.

In particular, the socket of the present invention comprises a generally tubular socket body having first and second ends. A means for mating with a drive portion of a tool such as a socket wrench or driver is provided at the first end of the socket body, and an appropriately sized polygonal receptacle for receiving the head portion of a fastener is defined at the second end of the socket body. In a preferred embodiment, a pair of threaded holes penetrate the socket body in a plane displaced above the second end of the socket body. The holes form an angle of about sixty degrees relative to each other about the axis of the socket body. The threaded holes open into the polygonal receptacle and receive two set screws which may be adjusted in the direction of the axis of the socket body by turning with an allen wrench or the like.

The set screws may therefore securely engage portions of a fastener head within the polygonal receptacle to urge the head against a wall segment of the receptacle to retain the head in a fixed position relative to the socket body when the socket body is turned by a wrench or other driving tool. Thus, the socket securely grasps and turns the fastener, notwithstanding the presence of deformed head surfaces.

Although the preferred embodiments described herein are provided with a polygonal receptacle for use with a polygonal fastener, it is to be understood that a socket of the present invention may be provided with a suitable receptacle for use with any fastener having at least one flattened portion which may be engaged by a flattened wall segment of the receptacle.

BRIEF DESCRIPTION OF THE DRAWINGS

The foregoing and other objects, advantages and features of the invention, and the manner in which the same are accomplished, will become more readily apparent upon consideration of the following detailed description of the invention taken in conjunction with the accompanying drawings which illustrate preferred and exemplary embodiments, and wherein.

DESCRIPTION OF THE PREFERRED EMBODIMENT

Figure 1:
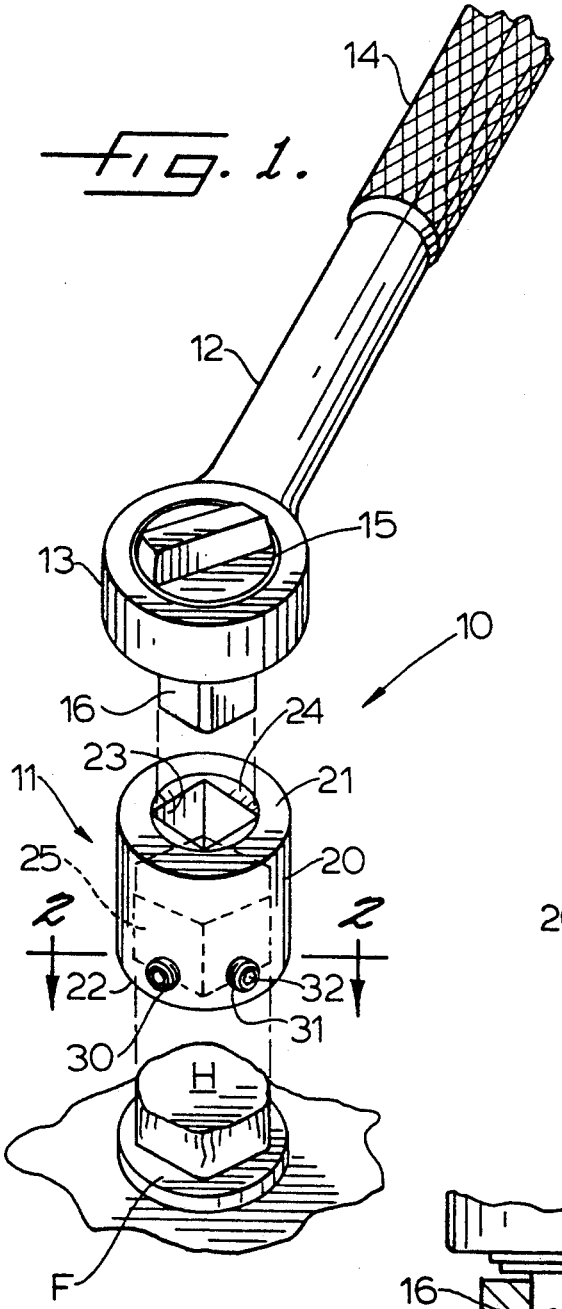
FIG. 1 is a perspective environmental view of one preferred embodiment of a tool made in accordance with the present invention.

Referring now to the drawings, FIG. 1 is a perspective view of one preferred embodiment of a tool made in accordance with the present invention designated generally at 10. As shown therein, the tool 10 includes an interchangeable socket, designated generally at 11, and a wrench 12 having a turning head 13 and an extended handle 14 for generating a torque about the turning head 13. The turning head 13 may include a ratchet 15 so that the wrench 12 will exert a turning force in one direction only. Alternatively, the wrench 12 may be of any type suitable for generating a moment about the socket 11, including a stiff arm or breaker bar, or a screwdriver like tool having a handle aligned collinear with the axis of the socket 11. The turning head 13 may include ratchet 15 and a drive end 16. In a preferred embodiment, the drive end 16 has a generally square cross section on which the corners are beveled. The design of wrench 12 is well known to those having skill in the art and need not be described further herein.

The socket 11 includes a socket body 20, which is made of hardened steel or another suitable durable material. The socket body 20 has a generally tubular shape, although other shapes may be used, and has a first end 21 and a second end 22 arranged transverse to its longitudinal axis. The first end 21 defines means for mating with the drive end 16 of the wrench 12. In a preferred embodiment, the means for mating with the drive end 16 is a rectangular opening 23 which is of an appropriate size to receive the drive end 16 therein. A beveled surface 24 may also extend around the upper portion of the rectangular opening 23 to facilitate insertion of the drive end 16 into the rectangular opening 23.

A polygonal receptacle 25 is defined at the second end 22. The polygonal receptacle 25 extends substantially into the interior of the socket body 20. The polygonal receptacle 25 has a size, typically of English or metric proportions, which is selected so that the receptacle 25 fits closely over a standard size head H of a threaded fastener such as a bolt, screw or the like. The polygonal receptacle 25 has a depth measured from the second end 22 that is sufficient to permit all or substantially all of the fastener head H to fit within the receptacle 25. Ideally, the polygonal receptacle 25 is sufficiently deep to allow the socket 11 to completely enclose the fastener head H, so that the second end 22 abuts against flange F of the fastener head H.

The design of socket 11 is well known to those having skill in the art, and will not be described further herein. As is also known to those having skill in the art, one or more wrenches and a plurality of sockets of different sizes are widely sold as "socket wrench sets". Likewise, a plurality of sockets having different sizes may be sold as a "socket set."

Still referring to FIG. 1, at least one engagement means is mounted in the socket body 20 adjacent the second end 22. The engagement means extends into the polygonal receptacle 25 and is adjustable in a direction perpendicular to and intersecting the longitudinal axis of the socket body 20. The engagement means is adapted to engage a flat portion of a fastener head H received within the polygonal receptacle 25 to urge the fastener head H against the side of the polygonal receptacle 25.

In a preferred embodiment, the engagement means comprise at least one threaded hole 30 which extends through the socket body 20. A set screw 31 having a size appropriate to engage threads in hole 30 is received within the hole 30. In a preferred embodiment, two holes 30 penetrate the socket body 20 at an angle of about 60° relative to one other in a plane generally perpendicular to the longitudinal axis of the socket body 20.

The set screws 31 may include a means for engaging a tool so that the set screws 31 may be easily turned. In a preferred embodiment, the means for engaging a tool on set screws 31 comprise an allen wrench receptacle 32. Alternatively, however, a slot for a screwdriver may be used, or the tool engaging means may be omitted altogether, in which case the set screws 31 may be turned manually.

In a preferred embodiment, the edges of the holes 30 and set screws 31 that are closest the second end 22 are displaced from the second end 22 by at least about 0.0625 inch. This displacement of the holes 30 and set screws 31 may be increased on sockets for turning large fastener heads, and may be decreased on sockets for turning small fastener heads. In the preferred embodiments, the diameters of the threaded holes 30 and the set screws 31 may vary between about 0.1 to 0.5 inch.

Figure 2:
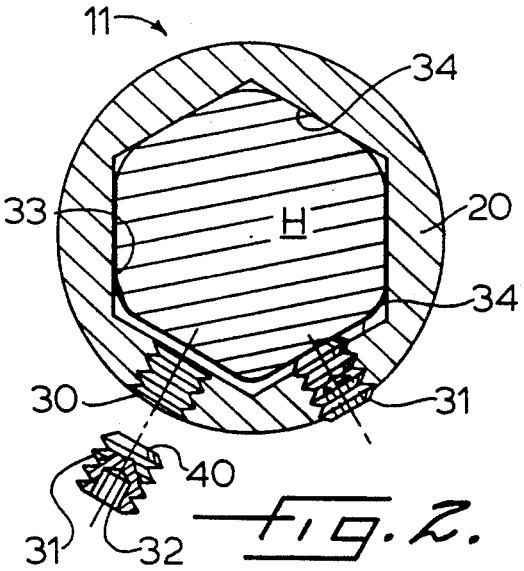
FIG. 2 is a cross sectional view taken along the line 2—2 of FIG. 1.

FIG. 2 illustrates a cross sectional view of one preferred embodiment of the socket 11 of the present invention, in which the polygonal receptacle 25 is a hexagonal opening 33. In this embodiment, the threaded holes 30 and set screws 31 pass through wall segments 34 of the hexagonal opening 33 and are preferably centered on adjacent wall segments 34 of the hexagonal opening 33.

Figure 3:
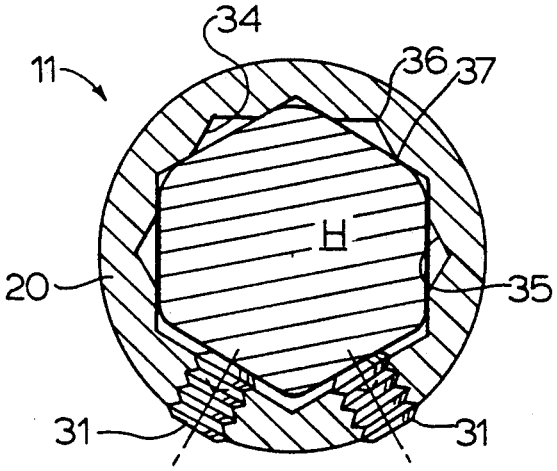
FIG. 3 is a cross sectional view of another preferred embodiment of the present invention.

In an alternative embodiment, as illustrated in FIG. 3, the polygonal receptacle 25 may be a dodecagonal opening 35. The dodecagonal opening 35 has twelve wall segments 34 adjoined by alternating acute vertices 36 and obtuse vertices 37. The acute vertices 36 of the dodecagonal opening 35 point towards the exterior of the socket body 20, whereas the obtuse vertices 37 point toward the center of the socket body 20. As shown in FIG. 3, in this embodiment the threaded holes 30 and set screws 31 are preferably positioned on acute vertices 36. Although only one threaded hole 30 and set screw 31 may be used, the preferred embodiment includes two threaded holes 30 and set screws 31 at a 60° angle relative to one another in a plane generally perpendicular to the longitudinal axis of the socket body 20.

The multiple holes 30 and set screws 31 may be positioned on nonadjacent wall segments 34 of a hexagonal opening 33. Likewise, the multiple holes 30 and set screws in a socket body 20 having a dodecagonal opening 35 may be set at angles other than 60°. Moreover, it is unnecessary that the holes 30 and set screws 31 intersect the axis of the socket body 20, although that arrangement has been found desirable.

Figure 4:
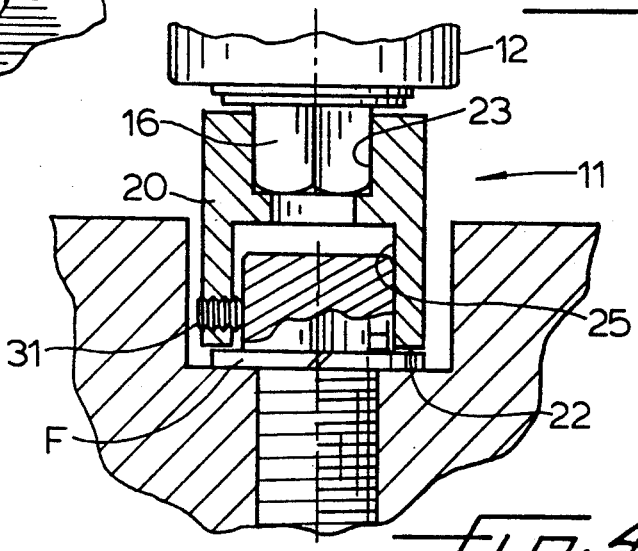
FIG. 4 is a partial cross sectional view taken along the axis of the socket body which shows the socket engaging a fastener head within a recessed area.

As illustrated in FIGS. 2, 3 and 4, the set screws 31 may be adjusted by turning, thereby causing the set screws 31 to advance along the threads of threaded hole 30 and resulting in axial adjustment of the set screws 31 toward the interior of the polygonal receptacle 25. Such adjustment of the set screws 31 may be used to move the foot portions 40 of the set screws 31 into a position adjacent flat portions of a fastener head H, thereby urging the head against the wall segments 34 opposite the set screws 31.

In use, the set screws 31 may be adjusted either when the fastener head H is within the polygonal receptacle 25 or before the socket body 20 is positioned over the fastener head H. It is generally preferable to adjust the set screws 31 after the head H is within the receptacle 25. However, as illustrated in FIG. 4, in some applications, it may be impossible to adjust the set screws 31 after the socket body 20 has been placed on the fastener head H due to space constraints. In this case, the set screws may be adjusted by trial and error, or may be adjusted using another fastener head of the same size as fastener head H.

The set screws 31 may be adjusted by hand such that they engage flat portions of a fastener head H relatively loosely. Alternatively, a tool such as an allen wrench may be used to drive the set screws 31 tightly against a fastener head H if a more secure engagement is desired. Of course, the socket 11 of the present invention may be used to turn fasteners both for tightening and loosening them.

In a preferred embodiment, the engagement means of the present invention is provided in all sockets of a socket wrench set to facilitate removal of all sizes of rounded fastener heads. Alternatively, some but not all of the sockets of a socket wrench set may include the engagement means. As another alternative, individual sockets having engagement means may be sold.

In the drawings and specification, there have been disclosed typical preferred embodiments of the invention. Although specific terms have been employed, they have been used in a generic and descriptive sense only and not for purposes of limitation, the scope of the invention being set forth in the following claims.

That which is claimed is:

1. A socket for grippingly engaging the polygonal portion of a threaded fastener and transferring a torque from a tool to the fastener to turn the fastener, said socket comprising:

a socket body having a longitudinal axis and first and second ends transverse thereto:

a rectangular opening defined by said socket body at said first end for mating with a drive end of a tool for rotating said socket body about said longitudinal axis;

a polygonal receptacle having a plurality of wall segments defined by said socket body at said second end for receiving the polygonal portion of a fastener; and at least one engagement means mounted in said socket body adjacent said second end and which extends into said polygonal receptacle, said engagement means being adjustable toward and away from said polygonal receptacle for engaging a fastener received within said polygonal receptacle to urge the fastener against at least one said wall segment of said polygonal receptacle, whereby a fastener having deformed polygonal surfaces may be securely grasped for turning.

2. A socket as defined in claim 1 wherein said engagement means comprise at least one threaded hole radially penetrating said socket body, and a set screw received therein which is adjustable toward and away from said polygonal receptacle to engage a fastener.

3. A socket as defined in claim 2 wherein said set screw includes means for engaging an allen wrench.

4. A socket as defined in claim 1 wherein said engagement means comprise two threaded holes, such that the axes of said holes form an angle of approximately 60° relative to one another in a plane generally perpendicular to said longitudinal axis of said socket body, and a set screw extending through each said threaded hole, said set screws being adjustable toward and away from said polygonal receptacle to engage a fastener.

5. A socket as defined in claim 4 wherein said set screws are adjustable in a direction perpendicular to and intersecting said longitudinal axis of said socket body.

6. A socket as defined in claim 1 wherein said polygonal receptacle comprises a hexagonal opening having six said wall segments.

7. A socket as defined in claim 6 wherein said engagement means is centered on at least one said wall segment.

8. A socket as defined in claim 1 wherein said polygonal receptacle comprises a dodecagonal opening having twelve said wall segments and alternating acute and obtuse vertices.

9. A socket as defined in claim 8 wherein said engagement means is positioned on at least one said acute vertex.

10. A socket as defined in claim 1 wherein said engagement means is substantially flush with the outer surface of said socket body to permit said socket to engage and turn a fastener positioned within a recessed area.

11. A socket for grippingly engaging the head portion of a threaded fastener and transferring a torque from a tool to the fastener head to turn the fastener, said socket comprising:

a generally tubular socket body having a longitudinal axis and first and second ends transverse thereto;

means defined by said socket body at said first end for mating with a drive end of a tool for rotating said socket body about said longitudinal axis;

a polygonal receptacle having a plurality of wall segments defined by said socket body at said second end for receiving the head portion of a fastener;

two threaded holes displaced at least about 0.0675 inch from said second end and radially penetrating said socket body at an angle of about 60° relative to one another in a plane substantially perpendicular to said longitudinal axis of said socket body and opening into said polygonal receptacle; and two set screws between about 0.1 and 0.5 inch in diameter which are received within said threaded holes substantially entirely beneath the outer surface of said socket body and which may be adjusted toward and away from said polygonal opening, whereby said socket body may extend into a recessed area to reach a fastener head therein having deformed head surfaces, whereby the fastener head may be positioned within said polygonal receptacle and whereby said set screws may engage flat portions of the fastener head to urge the head against at least one said wall segment of said polygonal receptacle, thereby retaining the fastener head in a fixed position relative to said polygonal receptacle to securely grasp the fastener for turning.

12. A socket as defined in claim 11 wherein said polygonal receptacle comprises a hexagonal opening having six said wall segments and wherein said threaded holes are centered on adjacent wall segments of said opening.

13. A socket as defined in claim 11 wherein said polygonal receptacle comprises a dodecagonal opening having twelve said wall segments and alternating acute and obtuse vertices and wherein said threaded holes are centered on two said acute vertices.

14. A tool for grippingly engaging the polygonal portion of a threaded fastener and transferring a torque to the fastener to turn the fastener, said tool comprising:

a wrench having a drive end and an extended handle for generating a torque about said drive end;

a ratchet mounted on said drive end so that turning of said extended handle will exert a torque about said drive end in one direction only;

a socket body driven by said drive end and having a longitudinal axis and first and second ends transverse thereto;

a polygonal receptacle having a plurality of wall segments defined by said socket body at said second end for receiving the polygonal portion of a fastener; and at least one engagement means mounted in said socket body adjacent said end and which extends into said polygonal receptacle, said engagement means being adjustable toward and away from said polygonal receptacle for engaging a fastener received within said polygonal receptacle to urge the fastener against at least one said wall segment of said polygonal receptacle, whereby a fastener head having deformed surfaces may be securely grasped for turning.

15. A tool as defined in claim 14 wherein said engagement means comprise at least one threaded hole radially penetrating said socket body, and a set screw received therein which is adjustable toward and away from said polygonal receptacle to engage a fastener head.

16. A tool as defined in claim 15 wherein said set screw includes means for engaging an allen wrench.

17. A tool as defined in claim 14 wherein said polygonal receptacle comprises a hexagonal opening having six said wall segments.

18. A tool as defined in claim 17 wherein said engagement means is centered on at least one said wall segment.

19. A tool as defined in claim 14 wherein said polygonal receptacle comprises a dodecagonal opening having twelve said wall segments and alternating acute and obtuse vertices.

20. A tool as defined in claim 19 wherein said engagement means is positioned on at least one said acute vertex.

21. A tool as defined in claim 14 wherein said engagement means is substantially flush with the outer surface of said socket body to permit said socket to engage and turn a fastener positioned within a recessed area.

22. A tool as defined in claim 14 further comprising a rectangular opening defined by said socket body at said first end for mating with said drive end of said wrench.

23. A socket wrench for grippingly engaging the polygonal portion of a threaded fastener and transferring a torque to the fastener to turn the fastener, said set comprising:

at least one wrench having a drive end and an extended handle for generating a torque about said drive end;

a ratchet mounted on said drive end so that turning of said extended handle will exert a torque about said drive end in one direction only;

a plurality of socket bodies each having a longitudinal axis and first and second ends transverse thereto;

means defined by each said socket body at said first end for mating with said drive end of said wrench;

a polygonal receptacle having a plurality of wall segments defined by each said socket body at said second end for receiving the polygonal portion of a fastener, each said polygonal receptacle in each said socket body having a size different from all other receptacles in said set; and at least one engagement means mounted in each said socket body adjacent said second end and which extends into said polygonal receptacle, said engagement means being adjustable toward and away from said polygonal receptacle for engaging a fastener received within said polygonal receptacle to urge the fastener against at least one wall segment of said polygonal receptacle, whereby a fastener having deformed polygonal surfaces may be securely grasped for turning.

24. A socket wrench set as defined in claim 23 wherein said engagement means comprise at least one threaded hole radially penetrating each said socket body, and a set screw received therein which is adjustable toward and away from said polygonal receptacle to engage a fastener.

25. A socket wrench set as defined in claim 23 wherein said means defined by each said socket body at said first end for mating with said drive end of said wrench is a rectangular opening.

26. A socket set for grippingly engaging the polygonal portion of a threaded fastener and transferring a torque to the fastener to turn the fastener, said set comprising:

a plurality of socket bodies each having a longitudinal axis and first and second ends transverse thereto;

a rectangular opening defined by each said socket body at said first end for mating with a drive end of a tool for rotating said socket body about said longitudinal axis;

a polygonal receptacle having a plurality of wall segments defined by said socket body at said second end for receiving the polygonal portion of a fastener, each said polygonal receptacle in each said socket body having a size different from all other receptacles in said set; and at least one engagement means mounted in each said socket body adjacent said second end and which extends into said polygonal receptacle, said engagement means being adjustable toward and away from said polygonal receptacle for engaging a fastener received within said polygonal receptacle to urge the fastener against at least one wall segment of said polygonal receptacle, whereby a fastener having deformed polygonal surfaces may be securely grasped for turning.

27. A socket set as defined in claim 26 wherein said engagement means comprise at least one threaded hole radially penetrating each said socket body, and a set screw received therein which is adjustable toward and away from said polygonal receptacle to engage a fastener.

28. A socket for grippingly engaging the flattened portion of a threaded fastener and transferring a torque from a took to the fastener to turn the fastener, said socket comprising:

a socket body each having a longitudinal axis and first and second ends transverse thereto;

a rectangular opening defined by each said socket body at said first end for mating with a drive end of a tool for rotating said socket body about said longitudinal axis;

a receptacle having at least one flattened wall segment defined by said socket body at said second end for receiving the flattened portion of a fastener; and at least one engagement means mounted in said socket body adjacent said second end and which extends into said receptacle, said engagement means being adjustable toward and away from said receptacle for engaging a fastener received within said receptacle to urge the flattened portion of the fastener against said at least one flattened wall segment of said receptacle, whereby a fastener having deformed surfaces may be securely grasped for turning.

29. A socket as defined in claim 28 wherein said engagement means comprise at least one threaded hole radially penetrating said socket body, and a set screw received therein which is adjustable toward and away from said receptacle to engage a fastener.

30. A socket as defined in claim 29 wherein said set screw is adjustable in a direction perpendicular to and intersecting said longitudinal axis of said socket body.

31. A socket as defined in claim 28 wherein said engagement means is substantially flush with the outer surface of said socket body to permit said socket to engage and turn a fastener positioned within a recessed area.

32. A tool for grippingly engaging the polygonal portion of a threaded fastener and transferring a torque to the fastener to turn the fastener, said tool comprising:

a wrench having a drive end and an extended handle for generating a torque about said drive end;

a socket body driven by said drive end and having a longitudinal axis and an end transverse thereto;

a polygonal receptacle having a plurality of wall segments defined by said socket body at said end for receiving the polygonal portion of a fastener;

two threaded holes radially penetrating said socket body, said threaded holes forming an angle of approximately 60° relative to one another in a plane generally perpendicular to said longitudinal axis of said socket body; and a set screw extending through each said threaded hole, each said set screw being adjustable toward and away from said polygonal receptacle for engaging a fastener head received within said polygonal receptacle to urge the fastener head against at least one said wall segment of said polygonal receptacle, whereby a fastener head having deformed head surfaces may be securely grasped for turning.

33. A tool as defined in claim 32 wherein said set screws are adjustable in a direction perpendicular to and intersecting said longitudinal axis of said socket body.

34. A socket wrench for grippingly engaging the polygonal portion of a threaded fastener and transferring a torque to the fastener to turn the fastener, said set comprising:

at least one wrench having a drive end and an extended handle for generating a torque about said drive end;

a plurality of socket bodies each having a longitudinal axis and first and second ends transverse thereto;

means defined by each said socket body at said first end for mating with said drive end of said wrench;

a polygonal receptacle having a plurality of wall segments defined by each said socket body at said second end for receiving the polygonal portion of a fastener, each said polygonal receptacle in each said socket body having a size different from all other receptacles in said set;

two threaded holes radially penetrating each said socket body, said holes forming an angle of approximately 60° relative to one another in a plane generally perpendicular to said longitudinal axis of each said socket body; and a set screw extending through each said threaded hole, each said set screw being adjustable toward and away from said polygonal receptacle for engaging a fastener received within said polygonal receptacle to urge the fastener against at least one said wall segment of said polygonal receptacle, whereby a fastener having deformed polygonal surfaces may be securely grasped for turning.

35. A socket set for grippingly engaging the polygonal portion of a threaded fastener and transferring a torque to the fastener to turn the fastener, said set comprising:

a plurality of socket bodies each having a longitudinal axis and first and second ends transverse thereto;

means defined by each said socket body at said first end for mating with a drive end of a tool for rotating said socket body about said longitudinal axis;

a polygonal receptacle having a plurality of wall segments defined by said socket body at said second end for receiving the polygonal portion of a fastener, each said polygonal receptacle in each said socket body having a size different from all other receptacles in said set; and two threaded holes radially penetrating each said socket body, such that the axes of said holes form an angle of approximately 60° relative to one another in a plane generally perpendicular to said longitudinal axis of each said socket body; and a set screw extending through each said threaded hole, each said screw being adjustable toward and away from said polygonal receptacle for engaging a fastener received within aid polygonal receptacle to urge the fastener against at least one said wall segment of said polygonal receptacle, whereby a fastener having deformed polygonal surfaces may be securely grasped for turning.

* * * * *

UNITED STATES PATENT AND TRADEMARK OFFICE

CERTIFICATE OF CORRECTION

PATENT NO. : 5,123,310

DATED : June 23, 1992

INVENTOR(S) : McManus

It is certified that error appears in the above-identified patent and that said Letters Patent is hereby corrected as shown below:

Column 8, line 17, after "said" please insert --second--.

Column 12, line 18, "aid" should be "said".

Signed and Sealed this

Thirtieth Day of November, 1993

Bruce Lehman

*Attest:*

BRUCE LEHMAN

*Attesting Officer*

*Commissioner of Patents and Trademarks*